US006425341B1

(12) United States Patent
Devin

(10) Patent No.: US 6,425,341 B1
(45) Date of Patent: Jul. 30, 2002

(54) BOAT HULL

(76) Inventor: Neville John Devin, 3 Pajingo Court, Annandale, Queensland 4814 (AU)

( * ) Notice: Subject to any disclaimer, the term of this patent is extended or adjusted under 35 U.S.C. 154(b) by 0 days.

(21) Appl. No.: 09/763,761

(22) PCT Filed: Aug. 30, 1999

(86) PCT No.: PCT/AU99/00702

§ 371 (c)(1),
(2), (4) Date: Apr. 27, 2001

(87) PCT Pub. No.: WO00/12380

PCT Pub. Date: Mar. 9, 2000

(30) Foreign Application Priority Data

Aug. 28, 1998 (AU) ..... PP 5555

(51) Int. Cl.[7] ..... B63B 1/20

(52) U.S. Cl. ..... 114/288; 114/290; 114/291; 114/343

(58) Field of Search ..... 114/343, 271, 114/288, 289, 290, 291; D12/310, 311, 312, 314

(56) References Cited

U.S. PATENT DOCUMENTS

| | | | | |
|---|---|---|---|---|
| 1,848,018 A | * | 3/1932 | Maranville | 114/291 |
| 3,577,948 A | * | 5/1971 | Frey | 114/286 |
| 3,967,571 A | | 7/1976 | Mut | |
| 4,672,905 A | * | 6/1987 | Pipkorn | 114/290 |
| 4,762,080 A | * | 8/1988 | Pearson | 114/219 |
| 4,924,792 A | | 5/1990 | Sapp et al. | |
| 5,458,078 A | | 10/1995 | Perette | |

FOREIGN PATENT DOCUMENTS

GB 2 014 515 A 8/1979

OTHER PUBLICATIONS

Derwent Abstract No. 96–022995/03, "Yanmar Diesel Engine Co", JP 07–267176–A (Oct. 17, 1995).

* cited by examiner

*Primary Examiner*—Sherman Basinger
(74) *Attorney, Agent, or Firm*—Nath & Associates PLLC; Gary M. Nath; Marvin C. Berkowitz

(57) ABSTRACT

A boat hull represented in a high speed attitude relative to a water surface-has a generally monohull section. A forward keel portion is flattened to form a plank-like planing surface having a replaceable shoe including stability extensions. Main bodies of sponsons are configured with air dams or spray walls. The sponsons define outer walls of side tunnels. The hull form, inboard of the side tunnels, provides side planing surfaces that step down transversely to the keel planing surface. Front and rear portions of the sponsons are connected by the air dam or spray walls and bound side tunnels having side planks or planing surfaces disposed at their inner edge. A step in the keel is provided to define a tunnel disposed between two downwardly depending side walls. Across afterplanes an integrated undersurface has an outboard motor insertion space with a continuation of the recess upper surface and provides a lateral boundary of a space. In use at speed, the planing surface supporting a bulk of a weight of the vessel includes a region including elements of the keel planing surface, portions of the main hull and side planing surfaces, with additional support and lift being generated by outer sponson contact areas.

23 Claims, 7 Drawing Sheets

BOAT HULL

This invention relates to a boat hull.

TECHNICAL FIELD

This invention has particular but not exclusive application to outboard motor powered monohull planing boat hulls, and for illustrative purposes reference will be made to such application. However, it is to be understood that this invention could be used in other applications, such as multihull vessels, seaplane floats or the like, inboard powered planing vessels, inboard outboard powered planing vessels, jet powered boats including personal jet skis (personal water craft) and airboats.

BACKGROUND OF INVENTION

In general, outboard motor powered boats have evolved from hull shapes generally designed for inboard power. Such hulls generally include a bottom part including a keel extending from stem to transom, the keel and its immediate surrounds providing a planing surface at speed. One disadvantage of this traditional type of planing hull is the disruption of the water behind the planing surface, which leads to propeller inefficiency. Of course, in single motor applications with monohulls, it is generally unavoidable that the planing surface precede the propeller along the centreline of the hull.

It has been proposed to partially overcome the disadvantages of traditional hull design by use of an extended transom or pod. However, the extended transom or pod places the weight of the outboard significantly behind the normal position relative to both the centre of gravity of the assembled rig and the planing surface at speed, disturbing the balance of the boat. This problem is exacerbated with the new heavier 4 stroke outboards becoming popular around the world.

As an improvement in the traditional planing hull and avoiding the disadvantage of pods or extended transoms, it has been proposed to step the transom to the keel of the hull to separate the keel from the propeller. In general such stepped designs include the underside of the step as part of the planing surface or at least part of the bearing surface under displacing conditions. Accordingly, such surfaces are generally provided with strakes and other interactive protuberances. Australian Patent Application No. 17654/88 (Haines 1988) discloses a hull having a transverse step of generally horizontal disposition and extending from the transom for approximately 5 to 15% of the waterline length of the hull ahead of the transom. It has been found that the disclosed apparatus when planing interacts with the surface 17 as much as the keel 11, generating spray and turbulence ahead of the propeller, and thus providing a source of inefficiency.

U.S. Pat. No. 1,396,831 (Gardner 1921) discloses a hull having a hull relieved by a cavity, the side walls of the cavity being configured to rake directly aft from the keel step to the transom and the recess defined thereby opens out essentially across the full width of the transom. The rake angle of the side walls, diverging sharply from the step, introduces cavitation in the turns. That this appears to have been an inherent problem with the apparatus disclosed in the cited reference becomes apparent when it is observed that the propeller is shown very low in the water. The decreased buoyancy of the aft portion of the vessel brought about by the substantially full-width transom opening results in the transom opening of the recess being fully submerged, and is thus not vented through the transom to assist initial release. The disclosure will also, by virtue of the limited lift aft and small planing surface area at the transom, be prone to porpoising until planing at high speed. Given the long length of the recess, this would have further increased the cavitation tendency mentioned earlier. FIG. 1 of the reference illustrates an apparatus wherein the top surface of the recess is minimally above the water line at rest. At low speed the cavity would be fully submerged as the application of power tended to drive the stern downward.

Similarly, reference DE 410034 (Bonnemaison 1925) discloses apparatus having a recess which is triangular and thus has all of the disadvantages inherent in the Gardner apparatus. The recess is almost full length and again it is full width at the transom. With the very small planing surface area near the transom, the present applicant doubts that the design would work and if it were to be operable at all, very large levels of power would be required to get it planing and it would be very prone to porpoising at low planing speeds.

With reference to U.S. Pat. No. 1,831,339 (Brush 1931), this discloses apparatus including a recess which is parallel sided and transverse to the boat at the front, like that referred to Australian patent application No 17654/88 (Haines 1988). The step extends for the full width of the hull and thus does not have stability in turns, since the downwardly depending side portions are substantially absent for a considerable distance aft of the step. The aft planing surfaces at each side of the hull are substantially flat and high lifting, preventing vessel trimming at speed. The disclosed apparatus uses a complex bottom in an attempt to have all 3 water contact points separated, and in this respect the disclosed apparatus is directed to effectively a planing multihull or foil borne apparatus rather than a planing monohull. The separation of the planing surfaces appears to be driven by a belief that all parts of the boat should operate in undisturbed water. This would greatly add to the manufacturing costs and because each of the rear planing surfaces is essentially horizontal, it will give excess spray in front of the propeller and so cause cavitation like the apparatus disclosed in 17654/88.

With reference to U.S. Pat. No. 3,547,064 (Glass 1968), the disclosed apparatus has a recess that is triangular and full width with the attendant disadvantages described above. The cited disclosure describes a hull adapted to touch the water at the transom immediately in front of the propeller when on the plane. The disclosed apparatus thus lacks the advantage of AU668684 of minimising the water disturbance in front of the propeller.

As the transom is not open, venting internally is necessary until the boat runs at very high speed. The disclosed apparatus has two delta shaped contact points with the water. As a result of the transom contact and the full width step, the venting is complex and therefore expensive. Because of the relatively small contact area at the transom, the applicant would expect that the disclosed boat, like the Gardner and the Bonnemaison designs, would be very prone to porpoising until running at very high planing speeds. The disclosure of the reference is express, at page 2, line 60, that the rear recessed section should be parallel with the front planing section. Page 4, line 3 of the disclosure also states an aim of trying to develop an air cushion requiring complicated venting and an attempt to introduce ram air.

WO 89/02846 (Monocat Powerboats) discloses apparatus having a catamaran form aft for planing With a deep-V form forward for sea keeping qualities. The disclosed apparatus is borne on three points. The tunnel shape is not a shape consistent with efficiently getting the boat on the plane or allowing the propeller (or propellers in the case of twin motor applications) to be mounted high and therefore to decrease the boat draft. The drawings of the reference show high speed ocean type race boats where these attributes would have not been important. The apparatus does not disclose placing the propellers behind the tunnel because the water there will be very disturbed because of the divergent shape of the tunnel. This design therefore will not achieve the objective of having relatively undisturbed water in front of the propeller and so increase the propeller efficiency. The drawings of the cited reference show the propellers behind the deep vee and this is only acceptable in race style boats using very expensive surface chopper propellers.

Australian Patent 668684 discloses a boat hull of the stepped type including a keel having a single planing surface adapted to substantially support the hull at planing speeds. The hull has a downwardly depending hull side portion disposed on each side of the keel and extending aft to a transom, and an upper substantially plane surface extending rearward from the step of said keel. The step and side portions and upper surface define a recess opening through and extending forward from the transom to the step. The recess extends for a substantial part of the waterline length of the hull and configured such that the upper surface at planing speeds is substantially clear of the water, the recess being provided with vent means to vent the recess to atmosphere as the hull approaches planing speed.

The boat hull described minimizes disturbance in front of the propeller and thus permits the propeller to operate in water substantially undisrupted by the keel of the hull. However, there has in some embodiments been the tendency to porpoising.

The present invention aims (when applied to a monohull) to provide the ride, handling and directional stability of a deep vee monohull, but with the speed, low wake, shallow draft and lateral stability of a flat bottom boat. It should also contain the spray to improve ride and speed and to decrease the water spray into the boat in windy conditions. It should also substantially alleviate the problem of disturbed water entering the propeller area which is one of the principal disadvantages of conventional boat hulls and the present invention further aims to provide an improvement over current stepped transom designs and the design of AU 668684, and to provide a boat hull which will be reliable and efficient in use. Other objects and advantages of this invention will hereinafter become apparent.

SUMMARY OF THE INVENTION

With the foregoing and other objects in view, this invention in one aspect resides broadly in a boat hull including:

- a forward keel portion having a forward planing surface formed thereon;
- a recess opening through and extending forward from a transom of the hull and meeting said keel at a step, said recess having an upper surface extending rearward from said step and opposed downwardly depending side walls;
- a pair of aft planing surfaces each formed-adjacent to and outboard of a respective one of said side walls and extending aft from the region of said step; and
- a pair of sponsons each formed outboard of a respective one of said aft planing surfaces.

The hull may be of any suitable type including monohulls and multihulls. Where a multihull or power cat type hull is required, a recess may be provided for each hull or keel or alternatively the recess may extend across both keels.

Preferably, the recess relieves the keel forward of the transom for at least 25% of the waterline length of the boat at planing speeds, with it being particularly preferred that the recess relieve the keel ahead of the transom for at least 40% of the planing waterline length. Typically, relief of the keel for 40% of the waterline length on the plane will amount to approximately 25% of the waterline length under displacing conditions. For typical deep-V type hulls, such criteria will translate to a recess length of at least 20% of the overall length, depending on the gross weight, speed and deadrise angle of the hull.

Preferably, the recess is configured such that at planing speeds the upper surface of the recess is substantially clear of the water surface. This provides for relatively uninterrupted water for the propeller, as well as decreasing the wetted area of the hull on the plane. A performance improvement, thought to be caused by the decreased wetted surface area when the boat is driven above planing speed, is noticeable when the upper surface of the recess comes clear of the water.

A further performance gain appears to be obtained by the aforesaid relatively undisturbed water in front of the propeller, in a manner thought to be analogous to that achieved with an extended transom or pod. In this area the advantage over a pod is that the distance between where the boat touches the water in front of the propeller and the propeller itself is increased significantly over that of the traditional hull, without disturbing the balance of the boat.

In order to facilitate the desired clearance without an excessive step it is preferred that the forward part of the upper surface of the recess be inclined rearward and upwards from the step. Preferably, the inclination of the forward part of the upper surface is selected such that the upper recess surface at planing speeds is at least parallel to and clear of the water. Of course, the surface may be more inclined than is necessary, and the rear portion of the upper surface will be approximately parallel to the keel to allow the same effective angle of attack when this surface is touching the water at low speeds. In a typical application, an inclination such as that described by a recess having a depth approximating 20% of the length of the forward sloping portion of the recess has been found to be adequate for typical planing hulls, although this will of course depend on the gross weight, speed, deadrise angle and planing angle of a particular hull.

The recess may be vented to the top of the hull or to the side to assist in breaking the suction of the upper surface of the recess to the water as the recess comes clear of the water. In some high speed applications, the upper surface of the recess may be so configured as to clear the water surface at a selected speed above the lowest planing speed. The vent allows the false bottom defined by the top surface of the recess to be released at a lower speed than it otherwise would but once released it is believed that the vent has no further significant effect. Alternatively, the opening of the recess through the transom may affect the venting as the vessel gains speed.

Preferably, the upper surface of the recess is a plane surface to avoid inadvertent interaction with the water surface in the planing condition, although the surface may be provided with reinforcing or ribs where these are deemed necessary to provide adequate strength or stability. Where such reinforcing or ribs are necessary, these may be provided within the hull rather than disturb the recessed upper surface.

The lower edges of the side walls bounding the recess may also be provided with spray rails, strakes or other means of engaging the water surface at planing speeds to increase lateral stability. These may take the form of bounding the recess at its sides by downwardly depending hull side portions, the hull side portions providing greater length of water contact in turns than when the hull is moving straight ahead. This provides a desirable increase in lateral stability in the turns by maximizing the length of the effective "keel" in the turns. Lateral stability limitations have been found to be a disadvantage of apparatus such as that disclosed in Australian Patent No. 585713 (Haines 1987) which proposes a full width transverse step, in embodiments where light-construction boats are provided with relatively large outboard motors. Such spray rails, strakes or other means of engaging the water surface at planing speeds are preferably parallel to the centerline to promote turn stability without increasing drag and spray generation.

The sponsons of the present invention may be selected in form such that at rest or at displacement speeds the length of the hull in the water is maximized to improve ride and stability whilst allowing the boat to plane at very low speeds. The sponsons are substantially lifted clear to provide a small contact area with the water at higher planing speeds. If desired, a degree of after planing surface may be provided towards the rear of the sponsons. The sponsons may incorporate a longitudinally disposed, generally downward depending air dam or spray wall. It has been found that such spray walls contain the spray and water which is ejected out the side and the rear of a typical mono or multi hulled boat as this represents wasted energy and causes the occupants of the boat to be wet in any more than light cross winds. Containing the spray and water also has been surprisingly determined to improve the ride of the hull at planing speeds. Trapping the spray and air also decreases the friction against the hull as aerated water has been shown to produce less drag than normal water. As well as increasing speed, this allows the boat to plane at lower speeds than either a conventional boat or the one described in AU 668684.

The spray walls may extend behind the aft planing surfaces to hold the spray away from the motor leg area. In embodiments utilizing afterplanes, such spray walls may be configured to keep the majority of the spray under and behind the after planes. Allowing spray into the motor leg area would increase motor corrosion (an accepted major problem in catamarans) and decrease the "lubricating effects of the spray" while the afterplanes are touching the water.

The configuration of the present hull serves to decrease the draft of the boat and to allow the motor to be mounted high and so allow operation in shallow water. This was also a characteristic of AU 668684, but the present invention allows the motor to be mounted even higher and for the boat to draw even less water at speed. The provision of a planing surface which extends to the rear of the step vis the aft planing surfaces and optionally the sponson aft planing surface allows the hull to run at almost constant angle (angle of attack to the water) regardless of the speed of the boat. This particularly applies when the boat is approaching planing speed, where the hull meets the resistance known as "getting over the hump". This reduction in bow up tendency also decreases the wake and the visibility and stability problems well known when a boat is operating around minimum planing speed. The contact areas at planing speeds also may have a constant angle of attack to improve efficiency and decrease the tendency for the boat to porpoise or rock sideways particularly in rough water, or may be configured to have differing angles of attack, depending on the overall hull form and geometry. Most monohull boats have a much lower angle of attack at the keel than at the chine as a consequence of the vee becoming deeper towards the bow. Having a constant angle of attack over the length and width of the boat allows the angle of attack to be more easily optimized in the "tuning" process.

The planing surfaces of the hull may be provided with a replaceable shoe, especially the keel planing surface, which is designed to be open over much of the forward part of lower surface and with a very sharp angle of entry to minimize forces when this area of the hull "slaps" into the water. The forward part of the shoe also traps air and so further minimizes hull "slapping" onto the water in rough water conditions. It is envisaged that the forward section of the keel replaceable shoe would be suitable for installation as an after market item on any mono, cat or multi hull. This shoe is of maximum benefit in improving the ride when it is fitted to a boat which operates at speeds such that the forward section of the keel is above the water when operating in smooth water. The replaceable shoes on all planing surfaces provides the ability to "tune" the boat to the preferred operating conditions and to replace the shoe when it is damaged. The shoes are preferably of a more durable material than the aluminium or glass composite preferred for the hull proper, such as stainless steel or some good wearing reinforced plastic or composite material. The shoe is preferably designed so it is easily removable with bolting or cutting. Insofar as other planing surfaces such as the side plank planing surface, the aft planing surfaces and sponson planing surfaces are concerned, these may be selectable as to form to provide the ability to tune the length and the width of the main and side planks to change the amount of lift generated near the transom of the boat and to change the centre of lift without major modifications to the overall boat hull. Spacers are frequently placed between motors and the transom to tune the boat by moving the centre of gravity of the boat further aft (by moving the motor further aft) and so introduce more bow lift at high speeds. Decreasing the overall length of the side planks at the transom end will allow the same effect in the present invention.

A useful effect of the hull forms of the present invention is to provide for a boat shape with deep section shape changes across the boat and so allow good strength in bending in the fore and aft direction regardless of whether it is constructed out of metal, wood or fibre reinforced plastic or composite.

One or more of the surfaces of the underside of the hull at the transom may be extended aft about the motor mounting in the form of afterplanes. The afterplanes disclosed in this specification may be constructed as planing surfaces or may be constructed with flotation having a planing undersurface. The use of afterplane flotation increases safety and stability in both fore and aft and lateral directions and provides a convenient access point onto the boat. The floatation in the afterplanes also decreases the tendency of the transom of the boat to bury deep into the water when being loaded onto or off trailers. This is very important in both shallow water and when loading or unloading the boat in rough water conditions e.g. launching in the sea. This flotation at the transom also allows the trailer to be almost completely out of the water while launching and retrieving the boat and this decreases the corrosion of the trailer, particularly in salt water.

The recess in front of the transom may mount external sensors and equipment which ordinarily would be mounted in an exposed position or at the transom. For example, an echo sounder transducer, water temp sensor and paddle wheel or petot tube speedometer may be mounted well forward in the boat without the complication of mounting the sensors through the hull. The cables may then be brought to the inside of the boat through the optional vents for the recess, or through grommets provided in this area, which would not require over rigorous sealing or watertightness. Water pickups (for example for live bait tanks) can be installed in the central recess and so provide "run aground" protection therefore.

The aft planing surfaces and optional sponson planing surfaces may be such that the keel planing surface is lifted so it is above the water at very high speed and so make the boat essentially like a tunnel hull or hydroplane at high speed and a mono at low planing speed. In the extreme, this would allow the pointed bow to be removed where decreased length was of benefit for example smooth water work and the boat would then essentially become a Catamaran or a Hydroplane with a complex shape in each sponson.

The afterplane may be fixed afterplanes, but an adjustable section in the form of trim tabs can be incorporated if side to side weight balance or additional for and aft adjustments are desired. The tabs may be incorporated at the rear end of the afterplanes, well behind the transom or alternatively at the rear end of the aft planing surfaces i.e. the front portion of the afterplanes or in front of the transom. If length reduction or weight reduction is important, the afterplanes could be deleted or size decreased and their effect decreased. Since the afterplanes are essentially out of the water at high speed, only small versions if any would be fitted to smooth water race boats.

Hulls having afterplanes in accordance with the present invention act as if the transom were stepped and so allow the rear contact point of the water to be adjustable (compared with the centre of gravity of the boat) by either extending or shortening the aft planing surfaces. This may be advantageous in getting the boat to have a good positive angle of attack at high speed as the tendency of a non stepped boat is to decrease the angle of attack as the speed increases and this is what causes high speed boats to need to run extreme out trim on the leg of the motor at high speed.

Apparatus in accordance with the present invention uses the same principle of minimizing disturbance in front of the propeller, compared with the hulls of AU 668684, but increases the length of the stepped central section and utilizes a boat design with a formed planing surface (flat plank) instead of a vee shape at the keel as described in the earlier patents. A vee shape at the keel can still be utilized With this design for simplicity, or improved ride if they were determining factors in the selection of the keel shape. When a flat plank keel is used, the forward section of the embodiment described in the earlier patent is now at right angles to the direction of travel. Air is also trapped under the hull, except in the recess, to improve ride and increase speed. At high speeds all of the afterplanes and most of the side sponsons are out of the water to minimize drag and so maximize speed. The detailed shape of the afterplanes and the speed at which they are completely above the water can be adjusted by the height and distance each part of the afterplane is behind the section of the hull ahead of the afterplane. This relationship between the hull and the afterplane can also be used to control the angle of attack of the boat at all operating speeds and the degree of banking of the hull in turns, both above and below planing speeds.

BRIEF DESCRIPTION OF DRAWINGS

In order that this invention may be more easily understood and put into practical effect, reference will now be made to the accompanying drawings which illustrate a preferred embodiment of the invention, wherein.

DETAILED DESCRIPTION

In the Figures there is generally illustrated by the numeral 10 a boat hull in accordance with the present invention and represented in a high speed attitude relative to a water surface 11. The technical details of the hull 10 insofar as its active surfaces and configuration are concerned are illustrated most clearly in the plan view of FIG. 2 and the transverse sections of FIGS. 3 to 7.

Figure 1:
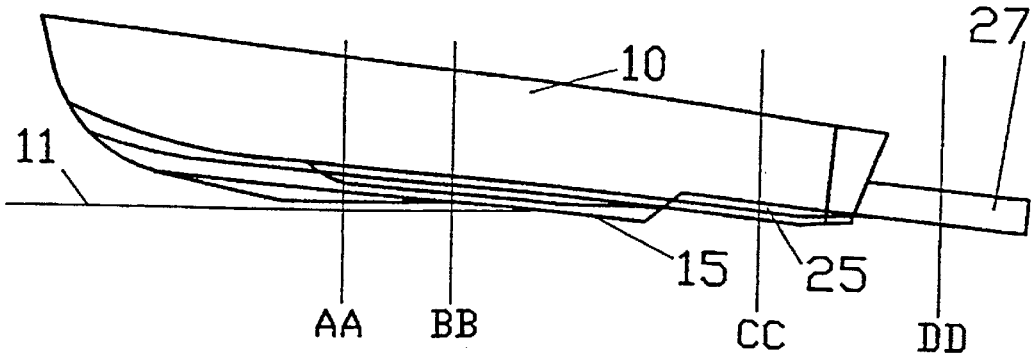
FIG. 1 is a side elevation of a boat hull in accordance with the present invention.
Figure 2:
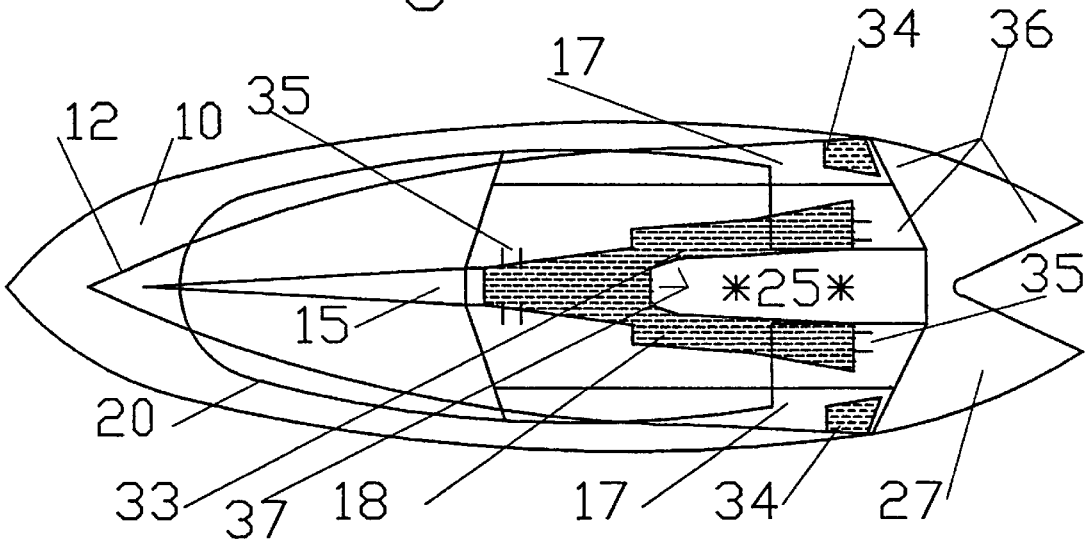
FIG. 2 is a plan view of the boat hull of FIG. 1 illustrating critical hull contact surfaces.
Figure 3:
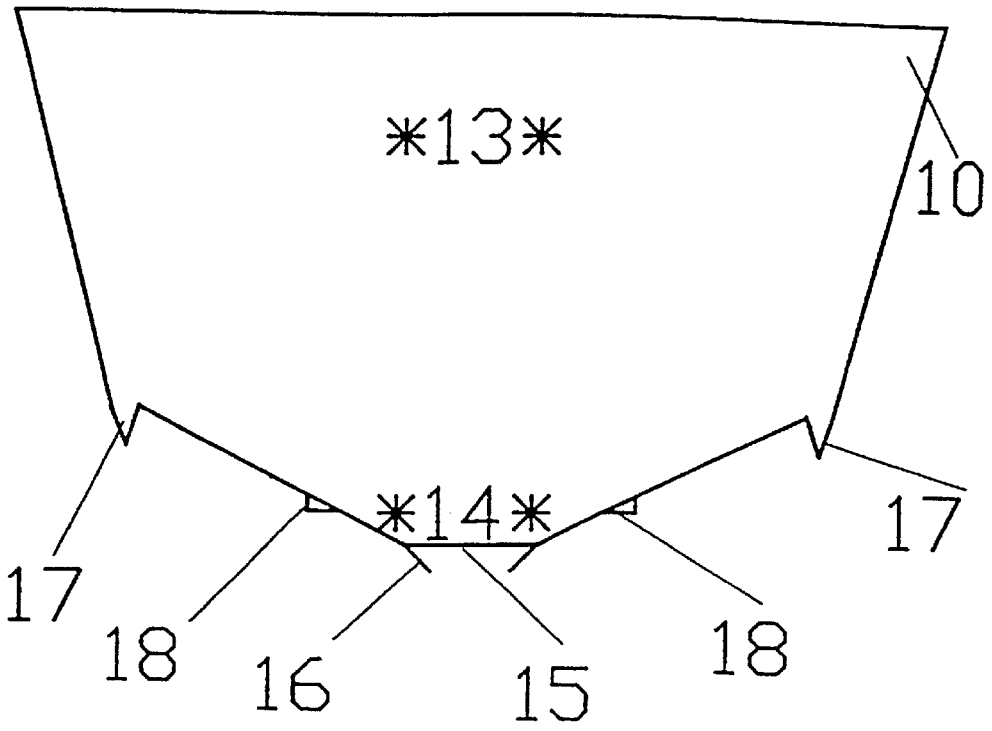
FIGS. 3 to 6 are transverse sections designated A—A to D—D through the hull of FIGS. 1 and 2.

In the plan view of FIG. 2, and moving aft from the bow end of the chine line 12, there is provided a generally monohull section 13 as illustrated in FIG. 3 corresponding to section line AA of FIG. 1. In this section, the forward keel portion 14 is flattened to form a plank-like planing surface 15. In the embodiment illustrated, the keel planing surface 15 is provided by means of a replaceable shoe including stability extensions 16. At the section AA illustrated in FIG. 3, the forward vestiges of sponsons 17 and side planing surfaces 18 can be seen. A foredeck plan line 20 is also illustrated in FIG. 2.

Figure 4:
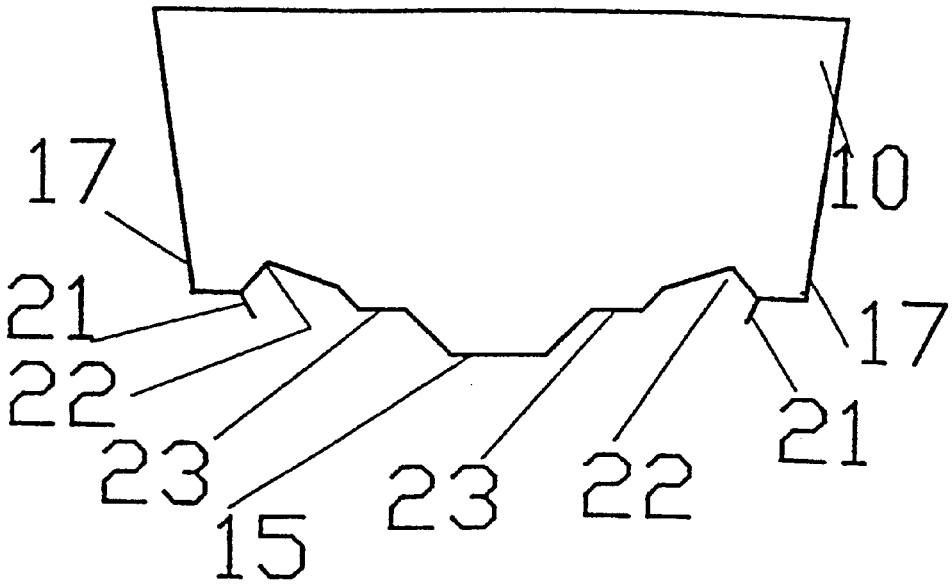

At the section BB illustrated in FIG. 4, the transition from the relatively conventional monohull section of FIG. 3 commences with the introduction of the main body of the sponsons 17 which are configured with air dams or spray walls 21, the sponsons 17 defining the outer wall of side tunnels 22. The hull form inboard of the side tunnels 22 is configured with the forward end of side planing surfaces 23 and thereafter steps down to the keel planing surface 15.

Figure 5:
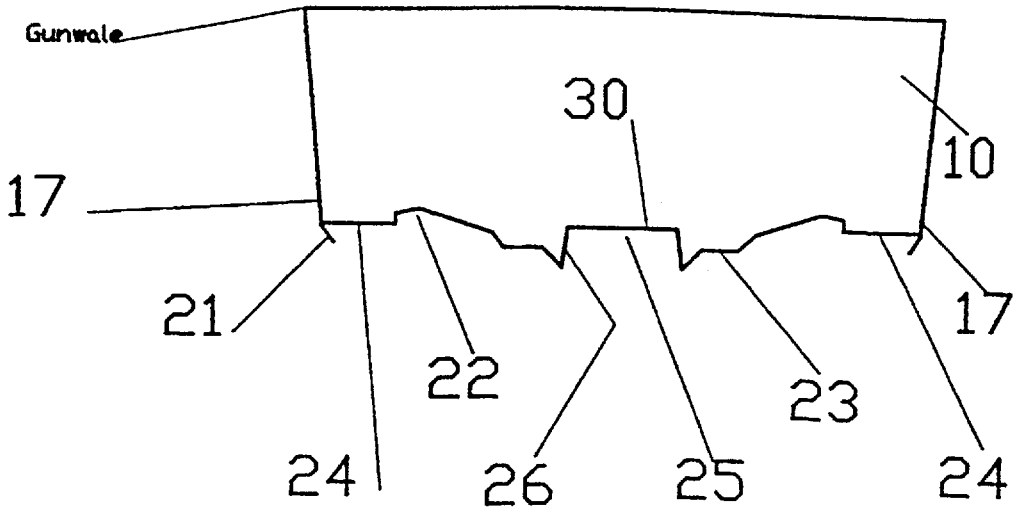

Proceeding further aft, in FIG. 5 the section CC illustrates the hull 10 wherein the section continues aft with the rear portion of the sponsons 17 and aft sections of their planing surfaces 24, the front and rear portions of the sponsons being connected by the aforementioned air dam or spray walls 21, again bounding the side tunnels 22 having the side planks or planing surfaces 23 disposed at their inner edge. The difference in this section is the provision of a step in the keel to define a tunnel 25 disposed between two downwardly depending side walls 26.

In the section DD, this is taken across after planes 27 and illustrating an integrated undersurface having an outboard motor insertion space 28 with a continuation of the recess upper surface 30 providing the lateral boundary of the space 28. The side tunnels 22 are generally continued into the after plane 27 as side tunnel extension 31 having an upper surface generally higher than the upper surface of the side tunnels 22, in this embodiment.

Figure 6:
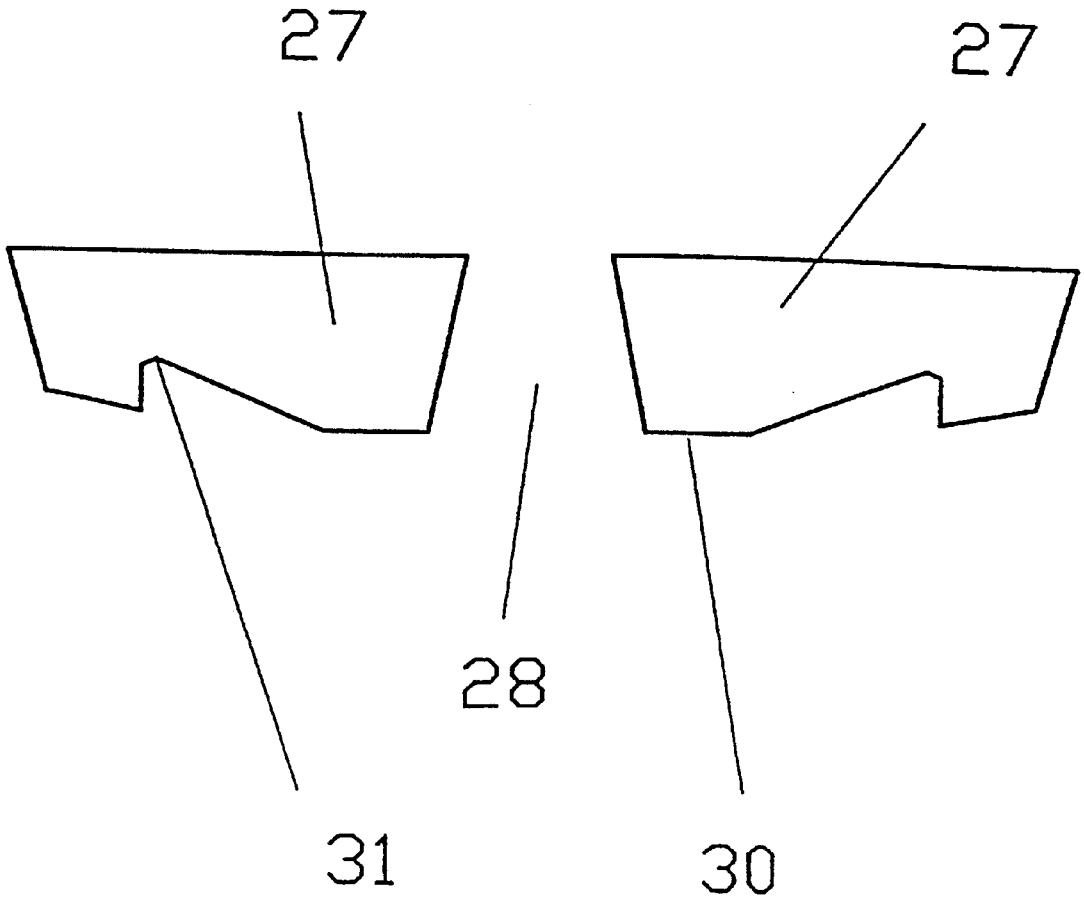
Figure 7:
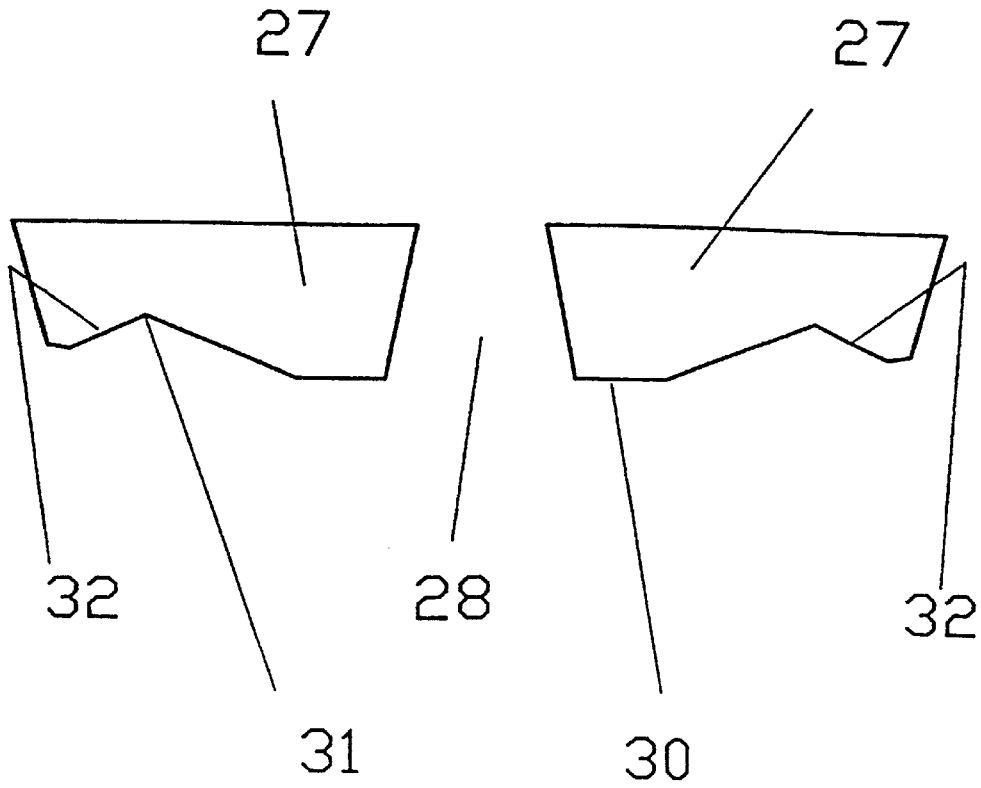
FIG. 7 is an alternative section D—D.

In the alternative after plane section of FIG. 7, the features are generally numbered as per FIG. 6, however in this embodiment, the side tunnel extensions 31 are relieved out at 32 to flatten the after plane section.

In use at speed, best illustrated in FIG. 2, the planing surface supporting the bulk of the weight of the vessel comprises the stippled region 33 comprising elements of the keel planing surface 15, portions of the main hull 10 and side planing surfaces 18, with additional support and lift being generated by similarly stippled outer sponson contact areas 34.

The elevation of FIG. 1 shows a side view of the boat including the stepped side sponsons, stepped plank style keel and the afterplane. The height of the steps and the relationship of this to the distance between steps has a significant impact on the angle of attack of the boat particularly at high speed. The angle of attack is shown with the horizontal line towards the front of the boat representing water level at high speed. The stepped planked keel is arranged to trap air when in rough water and so minimize rough ride.

The shape of this is shown in more detail in Section AA (FIG. 3), and are referred to as stability extensions of the plank in the bow area.

For some applications, there may be more or less than the 2 sponson and 1 keel steps shown in this design. The surface of each sponson touching the water is essentially horizontal laterally and parallel to the keel line of the boat. For some applications for example skiing where tight turning is required, some lift could be compromised and the sponsons made to slope upwards to the outside of the boat. Also the height of the sponsons could be arranged to be above the water at very high speed, whilst still retaining the value of the sponson arrangement described at lower operating speeds and while stationary.

FIG. 2 shows a plan view of the hull with the stippled area indicating the contact with the water at high speed. The central recess (or tunnel) covered by the earlier patent AU 668684 is clearly visible and this results in a relatively long water contact zone with a small surface area. FIG. 2 also shows the locations for vents 35 into the central tunnel and behind the side planks; 36 shows the alternative positions for trim tabs where fitted and 37 shows the alternative positions for sensors to cover speed temperature and echo sounder transducer in areas protected from damage. This sketch does not show the air dams or spray walls between the sponson steps to minimize the energy loss, trap air to improve ride and decrease spray to the outside of the boat. These air dams are however shown in Sections BB and CC (FIGS. 4 and 5). It also does not show the sloping walls along the side of bow section of the keel plank which trap air to minimize the slapping of the plank on rough water and so causing vertical accelerations which in turn cause a rough ride. These sloping walls 16 are however shown in Section AA. These extensions of the plank in the bow area is a feature which can effectively be fitted to conventional boats regardless of whether or not they are fitted with vee or plank shaped keels. For cost reductions or simplicity, either or both the spray walls may not be fitted in some applications. In some applications for example rough water, it may be beneficial to increase the waterline length of the boat and this can be done by having the rear end of the afterplanes still touching the water even at high speed. The waterline length at high speed will also be increased by the extensions of the plank in the bow area and increasing the depth of the keel steps will further increase the waterline length.

The angle of attack of the boat (trim angle) can be tuned at both low and high speeds by adjusting the height and the location of the steps; i.e. moving the rear end of the side sponson or the side plank or both, forwards, will increase the angle of attack at high speed and have virtually no effect on the angle of attack at lower speeds. This tuning is in addition to that normally done with fore to aft weight distribution, use of trim tabs and motor (or leg) trim angle.

The trim angle at lower planing speeds can be adjusted by increasing the height of the rear end of the front section of the side sponson as this creates significant lift at lower speeds, but is intended to be clear of water at high speed so has no effect on high speed angle of attack.

The trim angle at displacement speed can be changed by alterations to the surface area of the afterplanes and the displacement volume of the afterplanes. Since these don't touch the water at high speed, they also have no effect on high speed angle of attack. The plan view does not show the replacement shoe covering the plank surface which could include the sloping walls on the side of the plank referred to in an earlier paragraph. This replacement shoe, would be the first part of the boat to touch debris or ground, and its fitment would allow this to be made from more durable material than the majority of the boat hull. It also allows the shape of the shoe to be tailored to specific requirements e.g. good ride at the expense of speed. This replaceable shoe also incorporates the sloping walls referred to above. The replaceable shoe is not a requirement of the design and for simplicity and or cost reductions, this may not be fitted in some applications.

Section AA (FIG. 3) shows the cross section of the hull at the front end of the front sponson at Section AA as shown in the Elevation. Note that all lines shown as straight in all cross sections could be curved to simplify construction, to improve handling, to improve ride or improve strength in certain applications.

Section BB (FIG. 4) shows the section of the hull across the front sponson but in front of the tunnel.

Section CC (FIG. 5) is a section across the rear sponson and across the tunnel of the hull.

These sketches show a central planing plank, but it is not required for the design. If the plank was deleted, the tunnel shape would be exactly that shown in earlier patent AU 668684.

Section DD (FIGS. 6 & 7) shows two alternative sections of the forward section of the afterplanes. The central part of both sections are shown at the same height as the recess (tunnel) in front of it. In some applications, this may not be at the same height and the afterplane may not be flat in the central part as shown in this figure. The after plane side tunnel extension may be of the same height as the side tunnel top surface, or may be higher than it.

In the preferred embodiments the section shapes provide air access at both low and at high speeds so there is no venting required except for behind the rear section of the side planks and the central recess (tunnel) as discussed in earlier patent AU 668684.

The air trapped under the hull is a function of the square of the speed and this trapped air increases the speed for any level of power and also improves the ride by partially supporting the hull on a cushion of air. This is more noticeable at high speed and in some applications, it is beneficial to increase the tendency to trap air under the hull. This can be done by extending the walls (air dams) associated with the sponsons further forward and also by adding walls under the afterplanes, behind the side planks as this decreases the tendency to allow air to escape into the rear section of the recess and the front central section of the afterplanes. Further walls can be added under the afterplanes and behind the sponsons to stop the loss of air and spray out the sides of the boat in the afterplane area. To maximize the efficiency of the air dams, it is expected that they will generally be out of the water at high speed to minimize drag and for the bottom surfaces to be parallel to the water to minimize the air losses at speed.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

What is claimed is:

1. A boat having a hull, the hull comprising:

a keel having a forward keel portion having a forward planing surface formed thereon;

a recess opening through and extending forward from a transom of the hull and meeting said keel at a step, said recess having an upper substantially plane surface extending rearward from said step and opposed downwardly depending side walls, the upper surface configured to be essentially clear of a water at planing speeds;

a pair of aft planing surfaces each formed adjacent to and outboard of a respective one of said side walls and extending aft from the region of said step; and a pair of sponsons each formed outboard of a respective one of said aft planing surfaces.

2. A boat hull according to claim 1, wherein the recess relieves the keel forward of the transom for at least 25% of a waterline length of the boat at planing speeds.

3. A boat hull according to claim 2, wherein said recess relieves the keel ahead of the transom for at least 40% of the planing waterline length.

4. A boat hull according to claim 1, wherein a forward part of said upper surface of the recess is inclined rearward and upwards from the step.

5. A boat hull according to claim 4, wherein said inclination of the forward part of the upper surface is selected such that the upper surface of the recess at planing speeds is at least parallel to and clear of the water.

6. A boat hull according to claim 1, wherein said recess is vented to a top of the hull or to a side to assist in breaking a suction between the upper surface of the recess to the water as the recess comes clear of the water.

7. A boat hull according to claim 1, wherein lower edges of the side walls bounding the recess are provided with lateral stabilizing means selected from spray rails, strakes, air dams and other additions used to limit the flow of water, air or spray into the recess.

8. A boat hull according to claim 7, wherein the side walls bounding the recess at its sides comprise downwardly depending hull side portions, the hull side portions having minimal contact with the water when the hull is moving straight ahead, and provide greater length of water contact in turns.

9. A boat hull according to claim 1, wherein said sponsons are selected in form such that at rest or at displacement speeds a length of the hull in the water is maximized to improve ride and stability whilst allowing the boat to plane at very low speeds.

10. A boat hull according to claim 9, wherein said sponsons are substantially lifted clear to provide a small contact area with the water at higher planing speeds.

11. A boat hull according to claim 1, wherein a degree of after planing surface is provided towards a rear of the sponsons.

12. A boat hull according to claim 1, wherein said sponsons incorporate a longitudinally disposed, generally downward depending air dam or spray wall.

13. A boat hull according to claim 1, wherein one or more of the planing surfaces of the hull are provided with a replaceable shoe.

14. A boat hull according to claim 13, wherein said at least one planing surface comprises a keel planing surface.

15. A boat hull according to claim 13, wherein said planing surfaces are selectable as to form to provide the ability to tune the length and the width of the surfaces to change the amount of lift generated near the transom of the boat and to change a center of lift without major modifications to the overall boat hull.

16. A boat hull according to claim 1, wherein the keel is fitted with a replaceable shoe of a configuration selected to improve a ride and handling of the boat and also be suitable for installation as an after market item on an existing monohull, catamaran or multi hull vessel.

17. A boat hull according claim 1, wherein one or more of the surfaces of the underside of the hull at the transom are extended aft about a motor mounting in the form of afterplanes.

18. A boat hull according to claim 17, wherein said afterplanes are selected from planing surfaces and flotation having a planing undersurface, the planing surfaces being substantially parallel to the keel and configured to be substantially clear of the water at high speeds.

19. A boat hull according to claim 18, wherein said afterplanes comprise trim tabs whereby side to side weight balance and/or additional fore and aft adjustments is provided.

20. A boat hull according to claim 19, wherein said trim tabs are incorporated at a position selected from the rear end of the afterplanes and the rear end of the aft planing surfaces at a front portion of the afterplanes.

21. A boat hull according to claim 17 wherein said afterplanes are essentially above water at high operating speeds.

22. A boat hull according to claim 1, wherein said recess in front of the transom mounts external sensors and equipment which ordinarily would be mounted in an exposed position or at the transom.

23. A boat hull according to claim 1, wherein the aft planing surfaces and planing surfaces provided on the sponsons are such that the keel planing surface is lifted so it is above the water at very high speed and so make the boat essentially like a tunnel hull or hydroplane at high speed and a monohull at low planing speed.

* * * * *